US005485254A

United States Patent [19]

Bogoshian et al.

[11] Patent Number: 5,485,254

[45] Date of Patent: Jan. 16, 1996

[54] METERING BLADE FOR SINGLE-COMPONENT MAGNETIC DEVELOPER IN A XEROGRAPHIC APPARATUS

[75] Inventors: Gregory V. Bogoshian, Rochester; John S. Berkes, Webster, both of N.Y.

[73] Assignee: Xerox Corporation, Stamford, Conn.

[21] Appl. No.: 371,907

[22] Filed: Jan. 12, 1995

[51] Int. Cl.[6] ..... G03G 15/09

[52] U.S. Cl. ..... 355/253; 118/658; 118/661; 355/259

[58] Field of Search ..... 355/259, 261, 355/251, 253; 118/651, 661, 656–658

[56] References Cited

U.S. PATENT DOCUMENTS

| | | | |
|---|---|---|---|
| 4,406,536 | 9/1983 | Suzuki et al. | 355/259 |
| 4,528,937 | 7/1985 | Kanno et al. | 118/657 |
| 4,536,075 | 8/1985 | Hoffman | 118/657 |
| 4,575,220 | 3/1986 | Sakamoto | 355/253 |
| 4,760,422 | 7/1988 | Seimiya et al. | 355/253 |
| 4,777,904 | 10/1988 | Gundlach et al. | 118/653 |
| 4,920,916 | 5/1990 | Mizuno et al. | 118/653 |
| 5,101,237 | 3/1992 | Molloy | 355/245 |
| 5,124,753 | 6/1992 | Asai et al. | 355/259 |
| 5,185,632 | 2/1993 | Yoshida et al. | 355/261 |
| 5,191,170 | 3/1993 | Yoshida et al. | 355/245 |
| 5,210,575 | 5/1993 | Kikuchi | 355/259 |
| 5,212,522 | 5/1993 | Knapp | 355/208 |
| 5,243,385 | 9/1993 | Thayer | 355/212 |
| 5,270,786 | 12/1993 | Kikuchi et al. | 355/261 |
| 5,289,237 | 2/1994 | Hashizume et al. | 355/245 |
| 5,353,104 | 10/1994 | Kato et al. | 355/259 |

*Primary Examiner*—Robert Beatty
*Attorney, Agent, or Firm*—R. Hutter

[57] ABSTRACT

In a xerographic printer having single-component development, a metering blade that creates a uniform layer of toner on the developer roll is bowed with the ends of the blade curved toward the developer roll. The bowed blade results in more uniform metering pressure across the developer roll.

9 Claims, 4 Drawing Sheets

METERING BLADE FOR SINGLE-COMPONENT MAGNETIC DEVELOPER IN A XEROGRAPHIC APPARATUS

The present invention relates to developer apparatus for xerography. More specifically, the invention relates to a metering blade for toner conveyed to a photoreceptor as part of the development process.

In the well-known process of xerography, or electrophotographic printing, a charge retentive surface, known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as. "development." The object of effective development of a latent image on the photoreceptor is to convey toner particles to the latent image at a controlled rate so that the toner particles effectively adhere electrostatically to the appropriately-charged areas on the latent image.

A commonly used development technique involves a single-component developer material. In a typical single-component development system, each toner particle has both magnetic properties (to allow the particles to be magnetically conveyed to the photoreceptor) and an electrostatic charge (to enable the particles to adhere to the photoreceptor). In such a system, the developer roll is in the form of a cylindrical sleeve which rotates about a stationary magnet assembly. The magnetized toner particles adhere to the rotating sleeve by the force of the stationary magnets within the sleeve. As the sleeve rotates around the magnets, particles adhering to the sleeve are exposed to an alternating series of magnetic polarities.

A charge/metering or C/M blade is typically in continuous contact with the toner particles on the sleeve along one longitude of the developer roll. The C/M blade performs two simultaneous functions: it allows a uniform metered layer of toner to pass underneath, and uniformly charges the toner that is metered by mechanical means. That is, the action of the toner particles rubbing against the blade and each other while being metered by the blade induces a charge on the toner particles, much in the manner of rubbing a balloon against a wool cloth. The uniformity of the nip formed between the blade and the developer roll plays a significant role in creating a uniform charge of toner across the development roll. "Charge sharing" among particles, charge polarity, and charge level are also controlled through the use of charge control additives loosely attached to the surface of the toner particles.

When this thin layer of uniformly-charged particles is obtained, the developer roll advances the toner particles to a development zone adjacent the surface of the photoreceptor. In the development zone, the toner particles adhering magnetically to the developer roll are attracted electrostatically to the latent image recorded on the photoreceptor. AC and DC biases may be applied to the donor roll to enhance and control this process.

Single-component developers which are comprised mainly of toner particles having magnetic properties are particularly useful in a special segment of the electrophotographic printing market, the creation of magnet ink character recognition (MICR) documents. MICR documents are documents, such as checks, wherein the ink or toner forming the characters themselves has magnetic properties which are readable by special reading devices. As is well known, MICR characters as appear on checks are printed in special fonts by which each character creates a signature pattern of magnetic flux which can be recognized by a recognition program when the characters are run past a magnetic read head. Thus, in a single-component development system, the same magnetic properties which enable the toner to be conveyed around a developer roll are also useful for creating the magnetic properties of the characters on a sheet.

In practical embodiments of single-component development units for printers and copiers, it has been found that an element of great significance to ultimate print quality is the charge/metering or C/M blade, here generally referred to as a metering blade. The configuration of the metering blade, as well as the nature of the pressure exerted by the metering blade against the developer roll, has a direct effect on the height, uniformity of the layer of toner particles, and the charge retention of the toner particles on the developer roll. The specific charge retention of the particles has a direct effect on the properties of the toner particles in adhering to appropriately charged areas on an electrostatic latent image. If, for example, the pressure of the metering blade against the layer of toner particles on the donor roll (as opposed to the pressure against the donor roll itself) is not uniform, the toner particles along the length of the donor roll may not all have a uniform charge thereon; at the development nip, when the toner particles are made available to an electrostatic latent image, different areas of toner particles corresponding to different portions along the length of the donor roll, will have more or less tendency to adhere as desired to the electrostatic latent image. This lack of uniformity across the length of the donor roll may be evident as anomalies of toner coverage on printed images.

It has been found, in single-component development units for MICR printing, that the relatively high level of additives in such single-component developers tends to cause a "filming" of these additives on the surface of the donor roll. An accumulation of such filming will have an effect on the charge retention qualities of toner forming a layer on the donor roll. Such additives include titanium dioxide and powder flow enhancement additives such as that known under the trade name "Aerosil." For various reasons the extent of the filming is to some extent affected by the amount of localized pressure exerted by the metering blade against the toner layer on the donor roll. Further, it has been found that the behavior of certain designs of donor rolls are conducive to an accumulation of filming toward the middle of the donor roll. The present invention proposes a metering blade design which remedies these problems.

In the prior art, U.S. Pat. No. 4,528,937 discloses a single-component developer system wherein an alternating magnetic force is applied to a metering blade, which causes the metering blade to be magnetically attracted to the donor roll.

U.S. Pat. No. 4,536,075 discloses a magnetic-brush development apparatus, wherein toner particles are applied to a magnetic brush, and then the magnetic brush is applied to a photoreceptor.

U.S. Pat. No. 4,575,220 discloses a development unit having a pressure blade which creates a thin film of uniformly charged toner on a donor roll. A forward end portion of the pressure blade is shaped so that a projection having a width which substantially corresponds to the width of an image forming area extends beyond a contact line between the sleeve of the donor roll and the blade.

U.S. Pat. No. 4,760,422 discloses a developing device wherein a doctor blade urged against a developing sleeve is arranged such that a separating distance between the roll and the blade along a straight line normal to a tangential line drawn at a certain point downstream from the contact point is at least a certain distance.

U.S. Pat. No. 4,777,904 discloses a development device having a reverse-mounted doctor blade which is designed to interfere with flexible fibers on a rolling brush forming a "toner pump."

U.S. Pat. No. 4,920,916 discloses a developing device wherein the metering blade for forming a thin layer of toner includes a curved member at the end thereof. The curved member forming a radial plane of certain dimensions.

U.S. Pat. No. 5,101,237 discloses a metering roller, for use with a developing roll, which is unsymmetrical along its length. The metering roller distributes toner both toward and away from the developing roll, to eliminate significant pressure build-up within the development unit.

U.S. Pat. No. 5,185,632 discloses a metering blade having a curved portion thereon, the curved portion including a first curved surface and a second curved surface, the two surfaces having respective radii of a certain relation.

U.S. Pat. No. 5,191,170 discloses a developing apparatus wherein a developer layer forming blade includes a layered member having a charging layer. The conductive layer of the developing roller has a wear resistance equal to or greater than that of the charging layer of the developer layer forming blade.

U.S. Pat. No. 5,210,575 discloses a developing device having a thin-plate metering blade with an elastic member disposed at the free end portion of the blade. U.S. Pat. No. 5,270,786 discloses a similar design.

U.S. Pat. No. 5,212,522 discloses a system wherein the pressure exerted by a metering blade on a developer roll is automatically controlled by a feedback system responsive to the charge per unit area of toner adhering to the photoreceptor.

U.S. Pat. No. 5,243,385 discloses an apparatus for increasing the cleaning efficiency of a rigid blade used in a cleaning station, as opposed to a development station, of an electrophotographic printer. A center portion of a backing photoreceptor support roll is proportionately bowed outward toward the cleaning blade to compensate for nonuniform belt tension under the blade cleaner.

U.S. Pat. No. 5,353,104 discloses a developing device having a thin-plate metering blade which includes a surface which is chargeable frictionally to a polarity opposite that of the toner.

According to one aspect of the present invention, there is provided an apparatus for applying toner particles on a charge-retentive surface to develop an electrostatic latent image thereon. A donor member, defining two ends, rotatable in a process direction, conveys toner particles on a surface thereof from a supply of toner particles to a development zone at an area of close proximity to the charge-retentive surface.

According to another aspect Of the present invention, there is provided an electrostatographic printing apparatus, comprising a charge-retentive surface, adapted to retain an electrostatic latent image thereon, and a supply of toner particles. A donor member, defining two ends, rotatable in a process direction, conveys toner particles on a surface thereof from the supply of toner particles to a development zone at an area of close proximity to the charge-retentive surface. A metering blade is urged along a longitude of the donor member, the metering blade being bowed so that ends of the metering blade are curved toward the ends of the donor member.

In the drawings

Figure 4:
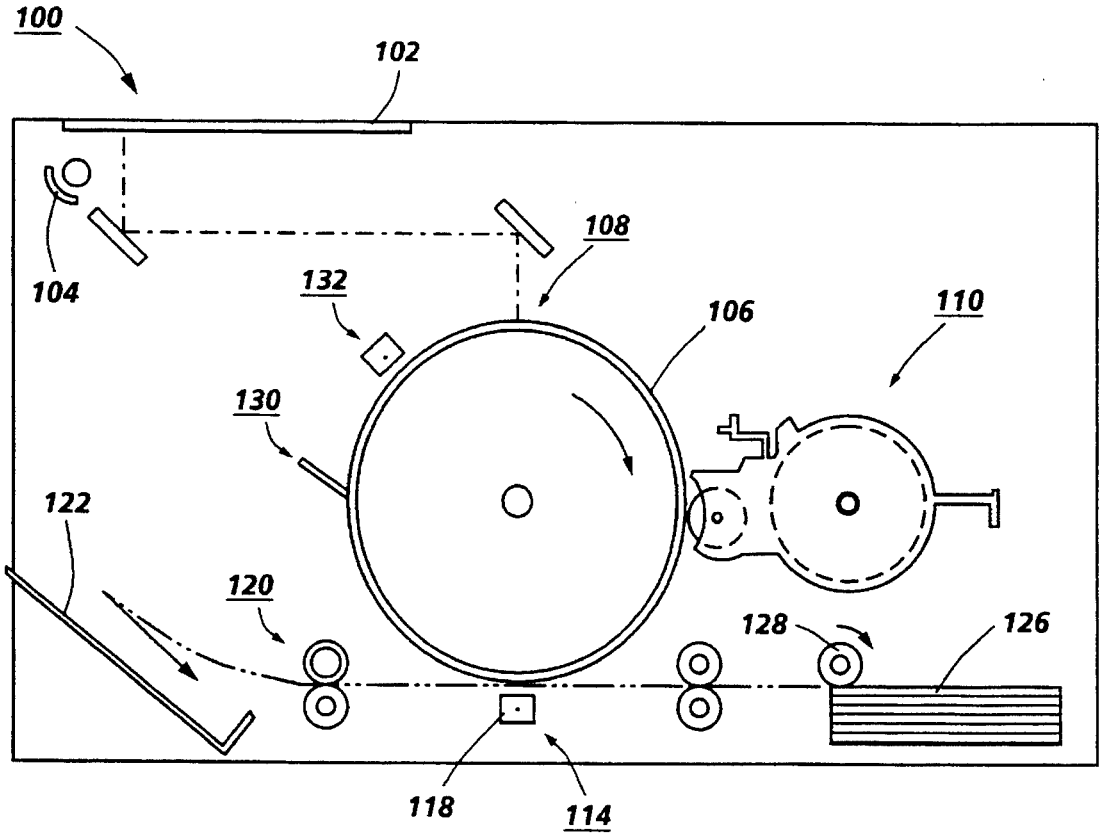
FIG. 4 is an elevational view showing the basic elements of a typical electrophotographic printer.

FIG. 4 shows the basic elements of a typical electrophotographic printer, shown generally by reference numeral 100. In electrophotographic printer 100, a document to be reproduced is placed on a platen 102 where it is illuminated in known manner by a light source such as a tungsten halogen lamp 104. The document thus exposed is imaged onto the photoreceptor 106 by a system of mirrors, as shown. The source of the original image to be printed may alternatively be a raster output scanner (ROS), wherein a laser source moving across the photoreceptor selectively discharges the photoreceptor in accordance with digital image data. In the example copier shown, the photoreceptor 106 is in the form of a rotating drum, although photoreceptors in the form of a belt are also known, and may be substituted therefor for purposes of the present invention. The optical image selectively discharges the surface of photoreceptor 106 in an image configuration whereby an electrostatic latent image of the original document is recorded on the drum 106 at imaging station 108. The photoreceptor drum 106 rotates so that the latent image is moved towards development unit 110, where the electrostatic latent image is developed, by the application of toner particles, into visible form. In the case of a single-component development system, toner from a supply hopper is gradually conveyed a rotating developer roll to a "development zone" adjacent the latent image recorded on photoreceptor drum 106. The details of the operation of the development unit 110 will be described hereinafter.

The developed image is transferred at the transfer station 114 from the photoreceptor drum 106 to a sheet of copy paper, which is delivered from a paper supply system into contact with the drum 106 in synchronous relation to the image thereon. At the transfer station 114, a transfer corotron 118 provides an electric field to assist in the transfer of the toner particles from the photoreceptor drum 106 to the copy sheet. Individual sheets are introduced into the system from a stack of supply paper 126 by a friction feeder 128. A separated sheet from stack 126 is fed, in the embodiment shown, by further sets of nip roll pairs through a path indicated by the broken line. The image is subsequently fused onto the paper in known manner at fusing station 120 and the finished copy is deposited in hopper 122. After the toner on the drum 106 is transferred to the paper, residual toner is removed from the surface of the photoreceptor drum 106, for example by cleaning blade 130, and then the surface is recharged, as by charging corotron 132, for imagewise discharging of the photoreceptor in a subsequent cycle.

Figure 1:
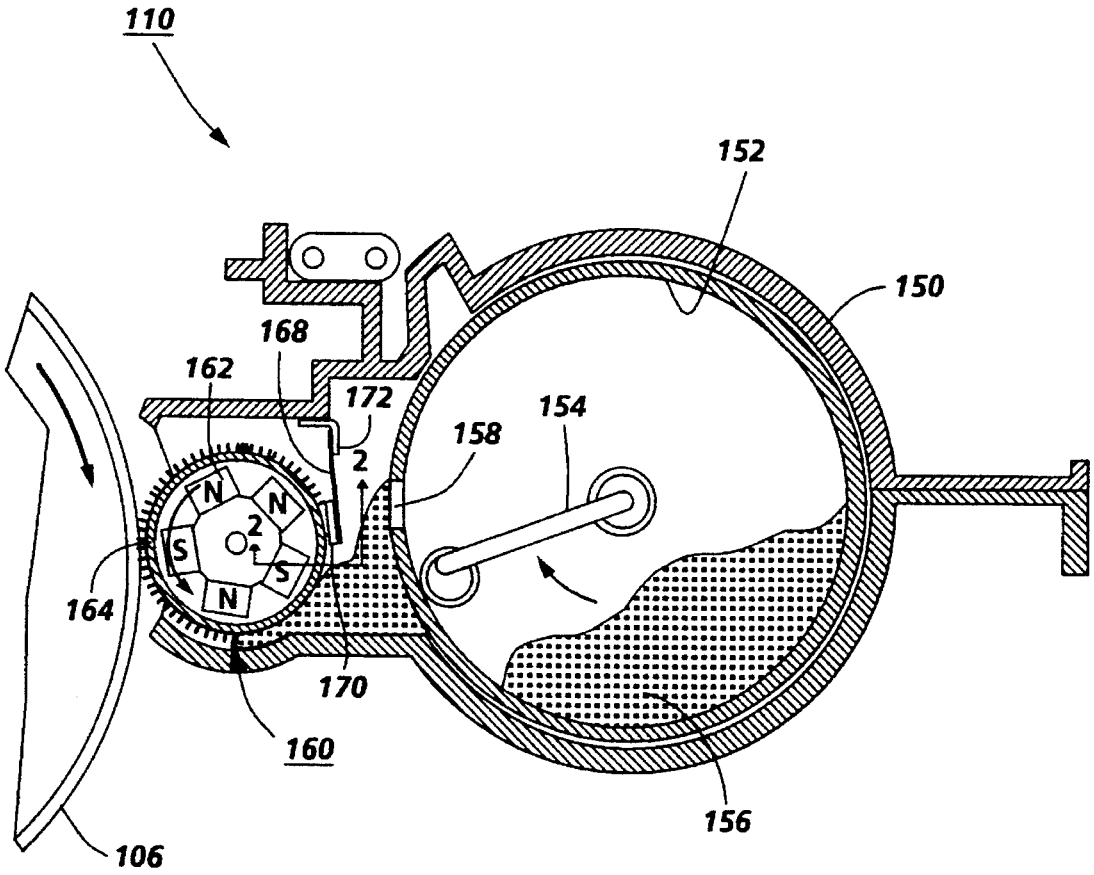
FIG. 1 is a sectional, elevational view showing a detail of the development apparatus of an electrophotographic printer.

FIG. 1 shows a single-component development unit, generally indicated by reference numeral 110. As typically constructed for a commercial application, the main body of development unit 110 is encased in a developer housing 150. The main part of the developer housing is, in this commercial embodiment, in the form of an enclosed cylindrical space which accommodates a cylindrical toner cartridge 152, shown in cross section. The toner cartridge 152 is typically made of an inexpensive material such as cardboard or aluminum. The toner cartridge 152 is preferably cylindrical so that it may be slid easily into the developer housing. It is typical that a toner cartridge 152 include a rotatable agitator 154, which engages a rotating driver in the apparatus. The purpose of agitator 154 is generally to keep the single-component developer (toner) well-mixed and aerated, so that the toner 156 will flow easily and will not coagulate in one area of the toner cartridge 152. Such an agitator 154 may also be useful in moving toner particles out of the toner cartridge 152 at a consistent rate.

A typical design of the toner cartridge 152 includes at least one opening 158 defined therein, in order that the toner 156 may be gradually taken out of the toner cartridge 152. In the design shown, opening 158 is in the form of one or more openings along a longitudinal axis of the cylindrical toner cartridge 152, the opening 158 being oriented adjacent developer roll 160. In this way, toner 156 may be gradually removed from the toner cartridge 152 and conveyed by a donor member, here shown as a developer roll 160, to the surface of photoreceptor 106.

The elements of a developer roll 160 in a single-component development system are a stationary magnet assembly 162, enclosed within a rotating cylindrical sleeve 164. Stationary magnet assembly 162 includes a plurality of permanent magnets, with each magnet extending substantially the length of the developer roll 160, and being arranged so that a selected pole of each magnet is exposed outward. The alternating polarities of the magnets create magnetic flux lines which extend outward toward the outer surface of the sleeve 164. In a typical single-component developer system, the toner particles have magnetic properties associated therewith, for example by virtue of a significant iron content, but generally no specific magnetic polarity. The magnets on magnetic assembly 162 generally cause the toner particles to adhere to the surface of outer sleeve 164, and the rotation of outer sleeve 164 causes the toner particles to, in effect, move around the developer roll 160 from the toner cartridge side of the developer roll 160 to a development zone adjacent the surface of the photoreceptor 106.

Although developer roll 160 is shown as having a rigid sleeve 164, it is conceivable that the "donor member" as recited in the claims herein can be any member for conveying the toner particles to the development zone, such as a flexible belt extrained on a plurality of rollers. The ends of the developer roll 160, as the term "ends" appears in the claims herein, are intended to be ends of the cylinder formed by a rigid developer roll 160; if the donor member is in the form of a flexible belt, the ends are intended to be the lateral edges of the belt.

Figure 2:
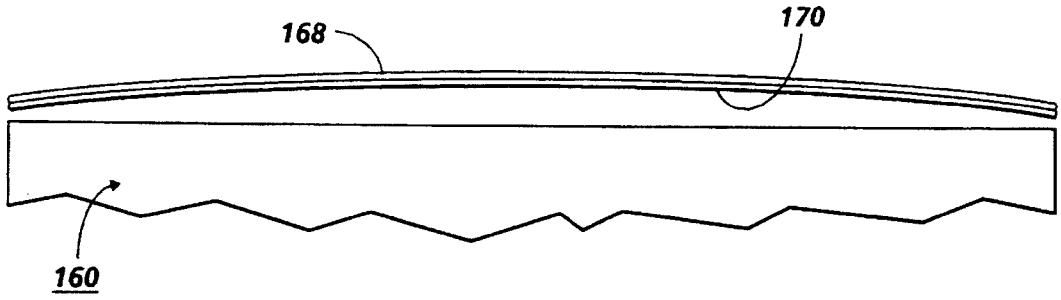
FIG. 2 is a sectional view through line 2—2 in FIG. 1, showing the configuration of a metering blade relative to a donor roll when the metering blade is separated from the donor roll and there is no toner in the system.

Metering blade 168 is typically an angled, somewhat resilient blade urged against the surface of the developer roll 160 along a longitude thereof. The purpose of the metering blade 168 is to smooth out the layer of toner particles on the sleeve 164 so that the layer will be uniform when it is brought into contact with the photoreceptor 106, and also to charge the toner. Metering blade 168 is, according to a preferred embodiment of the present invention oriented so that the blade "points" against the process direction of sleeve 164 as it moves in the counterclockwise direction as shown in FIG. 2 to convey toner particles to photoreceptor 106. Disposed at the free end of metering blade 168 is a compressible pad 170, which is preferably made of silicone plastic. The metering blade 168 is anchored in position by a blade holder 172. The metering blade 168 can be mounted on holder 172 by means of a continuous strip of adhesive, preferably in combination with one or more small rivets (not shown).

FIG. 2 is a cross-sectional view through line 2—2 in FIG. 1, showing the distinct bowed quality of the metering blade 168. According to one embodiment of the present invention, metering blade 168 is bowed so that, when metering blade 168 is not being urged against a longitudinal area on sleeve 164 of donor roll 160, the ends of the metering blade 168 are approximately 0.015 inches closer to the surface of sleeve 164 than the midpoint of the metering blade 168, for a metering blade approximately 11 to 12 inches long. This bow in the preferred embodiment of the present invention is readily obtained by slightly bending the plate forming metering blade 168 after attachment to the blade holder 172. Once the stainless steel plate forming metering blade 168 is placed on holder 172, the desired bow can be formed on the mounted plate by simple bending.

Figure 3:
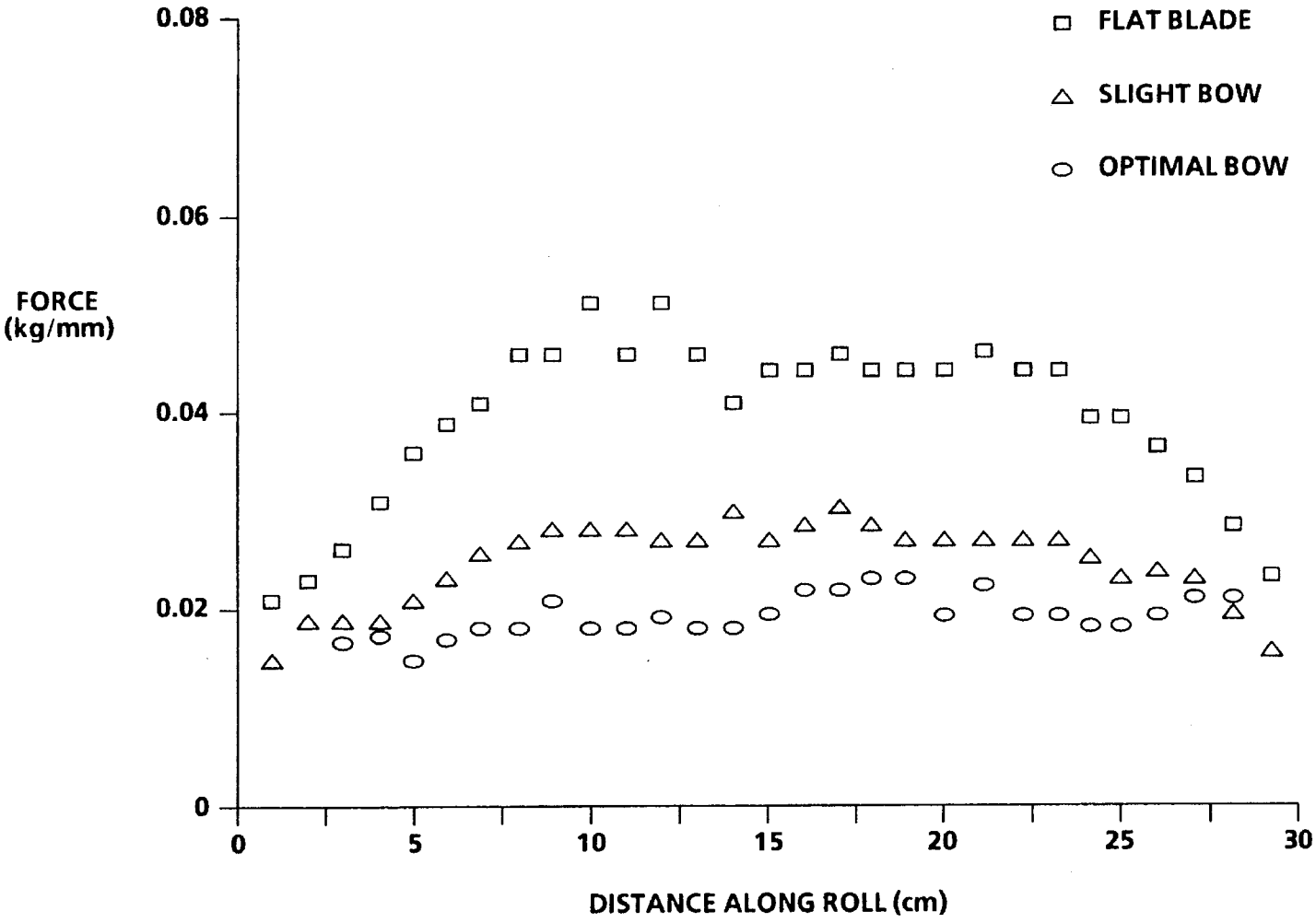
FIG. 3 is a graph showing the pressures exerted by various types of charge/metering blades against a surface of a developer roll as a function of location along the blades.

When the bowed metering blade 168 is urged into continuous contact with a longitude of the sleeve 164 of developer roll 160, the bowed quality of the metering blade 168 causes a more uniform urging force against the developer sleeve 164 across the entire blade. FIG. 3 shows the force exerted by the blade against the developer roll (in kg/mm of force to extract a shim from between the blade and the roll), as a function of the location along the blade, in cm from one end of the blade, for different types of blade designs. The object is to provide a uniform pressure across the entire blade, and thereby yield a uniform toner loading across the length of the developer roll. The different data sets in FIG. 3 show the pressure profile of a flat blade (the data points shown as rectangles in the graph), a slightly bowed blade (shown as triangles), and what the inventors consider a optimal practical blade according to the present invention (shown as ovals). The optimal blade is shaped to exert a relatively low, yet highly uniform, pressure across the developer roll; the bowed quality of the blade of the present invention facilitates this uniform pressure when toner is flowing under the blade.

The metering blade of the present invention further substantially reduces the problem of blade vibration which has been observed with prior art metering blades. This vibration of the metering blade 168 as sleeve 164 rotates also apparently results in filming of additives from the toner onto the sleeve of the developer roll. Because a bowed blade is less prone to vibration, the metering blade of the present invention is less prone to cause additives to be removed from the toner and smeared onto the surface of the developer roll.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

We claim:

1. An apparatus for applying toner particles on a charge-retentive surface to develop an electrostatic latent image thereon, comprising:

a donor member, defining two ends, rotatable in a process direction, adapted to convey toner particles on a surface thereof from a supply of toner particles to a development zone at an area of close proximity to the charge-retentive surface; and a metering blade urged against a longitude of the donor member, the metering blade comprising a resilient blade member defining a curved plane when there is no external pressure applied thereto so that the blade member exerts a greater pressure toward the ends of the donor member than toward a central portion of the donor member.

2. The apparatus of claim 1, further comprising a supply of single-component developer comprising toner particles.

3. The apparatus of claim 1, further comprising a magnetic assembly adapted to attract toner particles to the surface of the donor member.

4. The apparatus of claim 1, the metering blade including a compressible pad thereon in an area of close proximity to the donor member.

5. The apparatus of claim 1, the metering blade extending in a direction opposite the circumferential process direction of the donor member.

6. An electrostatographic printing apparatus, comprising:

a charge-retentive surface, adapted to retain an electrostatic latent image thereon;

a supply of toner particles;

a donor member, defining two ends, rotatable in a process direction, adapted to convey toner particles on a surface thereof from the supply of toner particles to a development zone at an area of close proximity to the charge-retentive surface; and a metering blade urged against a longitude of the donor member, the metering blade comprising a resilient blade member defining a curved plane when there is no external pressure applied thereto so that the blade member exerts a greater pressure toward the ends of the donor member than toward a central portion of the donor member.

7. The apparatus of claim 6, further comprising a magnetic assembly disposed relative to the donor member to attract toner particles to the surface of the donor member.

8. The apparatus of claim 6, the metering blade including a compressible pad thereon in an area of close proximity to the donor member.

9. The apparatus of claim 6, the metering blade extending in a direction opposite the circumferential process direction of the donor member.

* * * * *